US005413509A

United States Patent [19]

Castaldo

[11] Patent Number: 5,413,509

[45] Date of Patent: May 9, 1995

[54] MULTI-WIRE LOCKING SYSTEM

[75] Inventor: Cosmo Castaldo, Westbury, N.Y.

[73] Assignee: Leviton Manufacturing Co., Inc., Little Neck, N.Y.

[21] Appl. No.: 183,591

[22] Filed: Jan. 18, 1994

[51] Int. Cl.[6] ..... H01R 11/22

[52] U.S. Cl. ..... 439/851; 439/857

[58] Field of Search ..... 439/851, 852, 853, 854, 439/856, 857, 842

[56] References Cited

U.S. PATENT DOCUMENTS

| | | | |
|---|---|---|---|
| 3,980,385 | 9/1976 | Hirokawa | 439/748 |
| 4,666,227 | 5/1987 | Galizia | 439/851 |
| 5,106,329 | 4/1992 | Maeshima | 439/851 |
| 5,135,418 | 8/1992 | Hatagishi | 439/851 |

FOREIGN PATENT DOCUMENTS

| | | | |
|---|---|---|---|
| 42332 | 12/1981 | European Pat. Off. | 439/851 |
| 1440488 | 4/1966 | France | 439/851 |
| 3233652 | 3/1984 | Germany | 439/851 |

*Primary Examiner*—Gary F. Paumen
*Assistant Examiner*—James Miner
*Attorney, Agent, or Firm*—Paul J. Sutton

[57] ABSTRACT

The present invention teaches a multi-wire locking system incorporating a novel and unique ground contact which is formed in a unitary manner in a single piece or element from a single piece of metal stock, without the need for machining or assembly. The subject ground contact is utilized within and the present invention contemplates a receptacle or connector assembly which performs in a superior manner when compared to the prior art.

13 Claims, 7 Drawing Sheets

MULTI-WIRE LOCKING SYSTEM

BACKGROUND OF THE INVENTION

The present invention relates generally to the field of electrical connectors, and more particularly to a multi-wire locking system for use in commercial and industrial applications wherein male and female electrical connectors, each housing multiple wires, are locked together utilizing a unique ground contact.

The field of electrical connectors is old and well known, and has seen a myriad of designs which have sought in most cases to advance the state of the art to provide users with more reliable and safer products. One such manufacturer is Leviton Manufacturing Co., Inc., which has developed a line of booted products for use in commercial and industrial environments. The term "booted" as used within this specification is used to describe generally a system of male and female electrical connectors which matingly engage one another to provide an electrical junction or connection point between electrical appliances or equipment, by way of example only, and a source of electrical current which will power the load.

In applications with greater magnitudes of electrical voltages or current, the connectors must reliably and safely handle higher ratings in a manner which attempts to eliminate failures or degradation of the connections. An example of an existing manufacturer of such devices is Hubbell Incorporated, who for years has manufactured and sold relatively heavy duty electrical connectors for the commercial and industrial market. These connectors include plugs and receptacles, each multi-wired with, for example, three conducting wires which terminate within the plugs and receptacles at screw terminals, for example.

The receptacles of these conventional devices include a ground contact fabricated to be able to matingly receive the ground pin of the cooperating plug. The electrical connection between the ground pin and the ground contact which receives the pin is an important connection and must be reliable from an electrical conducting standpoint.

There is a drawback to the conventional ground contacts known to the art, however, such as those manufactured by Hubbell Incorporated. The Hubbell ground contacts are each machined parts which include at least two separate parts per contact, namely, a machined hub and what I will refer to here as a machined spring tube member which actually electrically engages the ground pin.

These machined parts require several machining steps each and then, only after the machining is completed, require assembly in the finished ground contact to be located within the electrical receptacle used in commercial or industrial applications. There is an obvious cost penalty associated with machined parts, as compared with fully automated formed parts. There is an increased cost of labor associated with machined parts, as compared with fully automated formed parts. There is a penalty of cost and labor associated with an assembly of two or more parts, as compared with fully automated production of a single part. There is also a time penalty associated with machined and assembled parts. Finally, there is a penalty associated with consistency where parts are machined and/or handled by more than one person, as compared to fully automated parts. Inspection of the Hubbell ground contact will show that a set screw is required to hold the plurality of machined parts together, these part being splined to mate.

These costs in time, labor and material, as well as any inconsistencies, are passed on to the purchasers of receptacles incorporating these ground contacts. While the present invention does not focus upon the ground pin, it is known that such pins are machined by Hubbell in a similar manner.

There has thus been a long felt need for a ground contact suitable for use in electrical connectors which will be used in commercial and industrial applications or environments, and which will not require machining and assembly of multiple parts in its manufacture.

SUMMARY OF THE INVENTION

The present invention satisfies the long felt need described above by teaching and providing a one-piece ground contact which is formed from a single piece of metal stock without any machining whatsoever. The ground contact incorporates a unique shape and configuration which serves to reliably make electrical contact with a ground pin inserted therewithin. It functions in a manner superior to the prior art contacts known to the trade, especially in circumstances where the mating plugs and connectors or receptacles are roughly handled or are manipulated in a manner which will bend or stress the components which carry electricity.

It is thus an object of the present invention to provide a unitary one-piece ground contact which is formed from a single piece or element of metal stock without the need for any machining.

It is a further object of the present invention to provide such a one-piece contact as part of a commercial and industrial plug and connector system.

It is another object of the present invention to provide a multi-wire plug and connector locking system incorporating such a unitary one-piece ground contact which does not require machining during its fabrication.

It is another object of the present invention to provide such a one-piece contact which is suitable for use in what is known in the trade as "pin and sleeve" type electrical connectors.

It is yet a further object of the present invention to provide a one-piece contact which may be fabricated from a single piece or element of metal stock, and which is self-centering within the connector or receptacle orifice in which it functions.

DETAILED DESCRIPTION OF THE INVENTION

The present invention will be appreciated and better understood by reference to the accompanying drawings in which.

Figure 3:
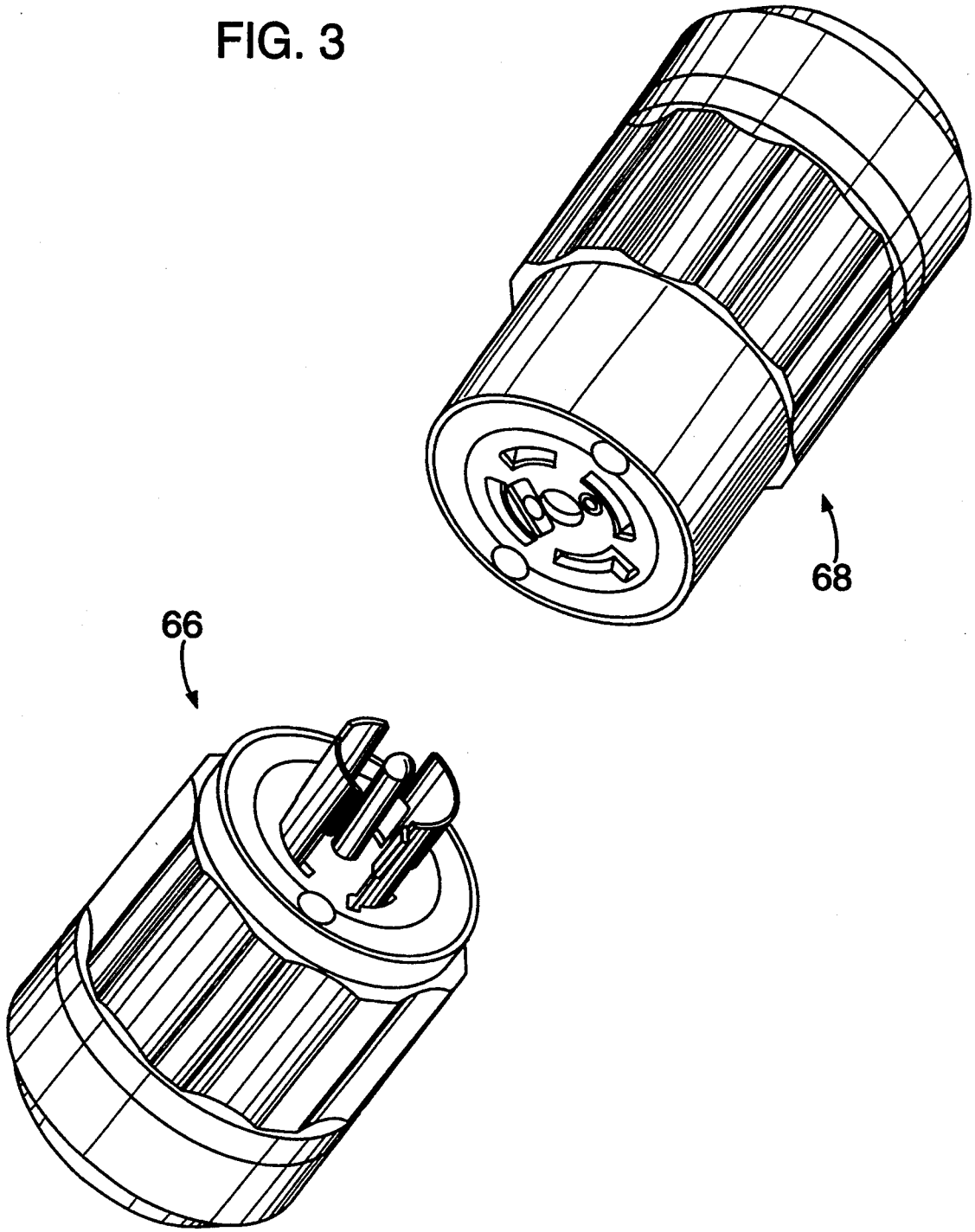
FIG. 3 is an upper right perspective view of an electrical connector equipped with the one-piece ground contact according to the present invention, illustrated adjacent its mating plug assembly.
Figure 9:
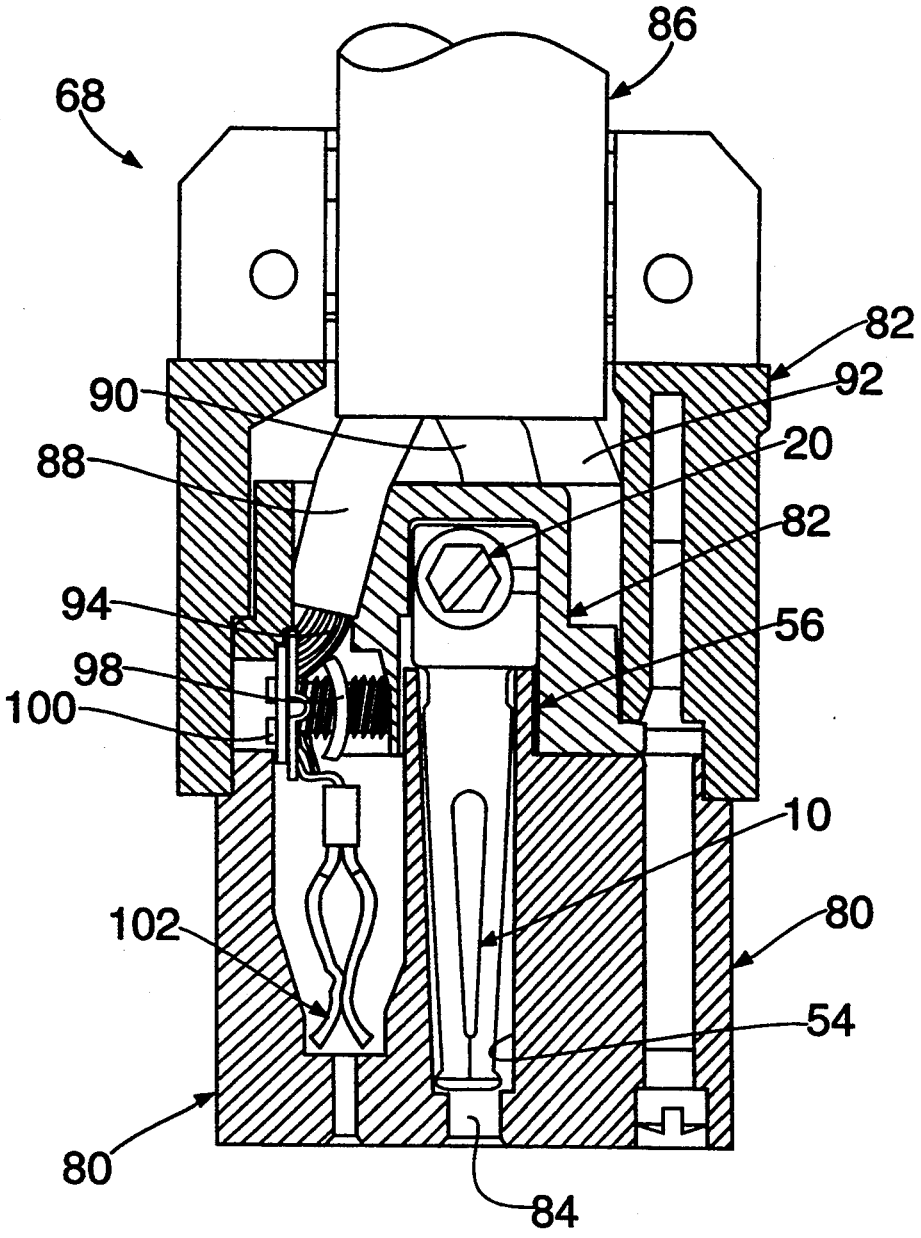
Figure 10:
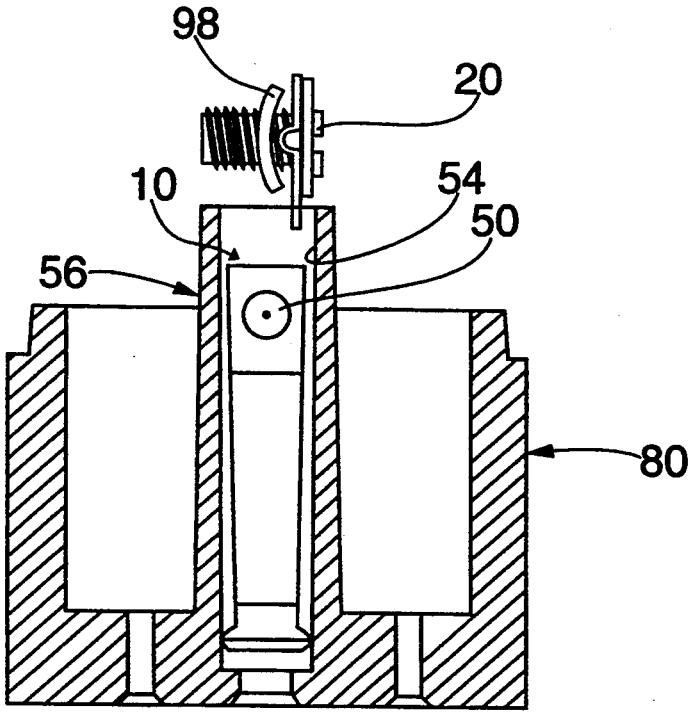

FIG. 9 is an enlarged sectional elevational view through the female connector of FIG. 3 illustrating the ground contact according to the present invention located within the body of the electrical connector in which it may function, and FIG. 10 is a simple enlarged sectional elevational view through a body of a connector, illustrating the placement of the self-centering protuberances according to the present invention.

Figure 1:
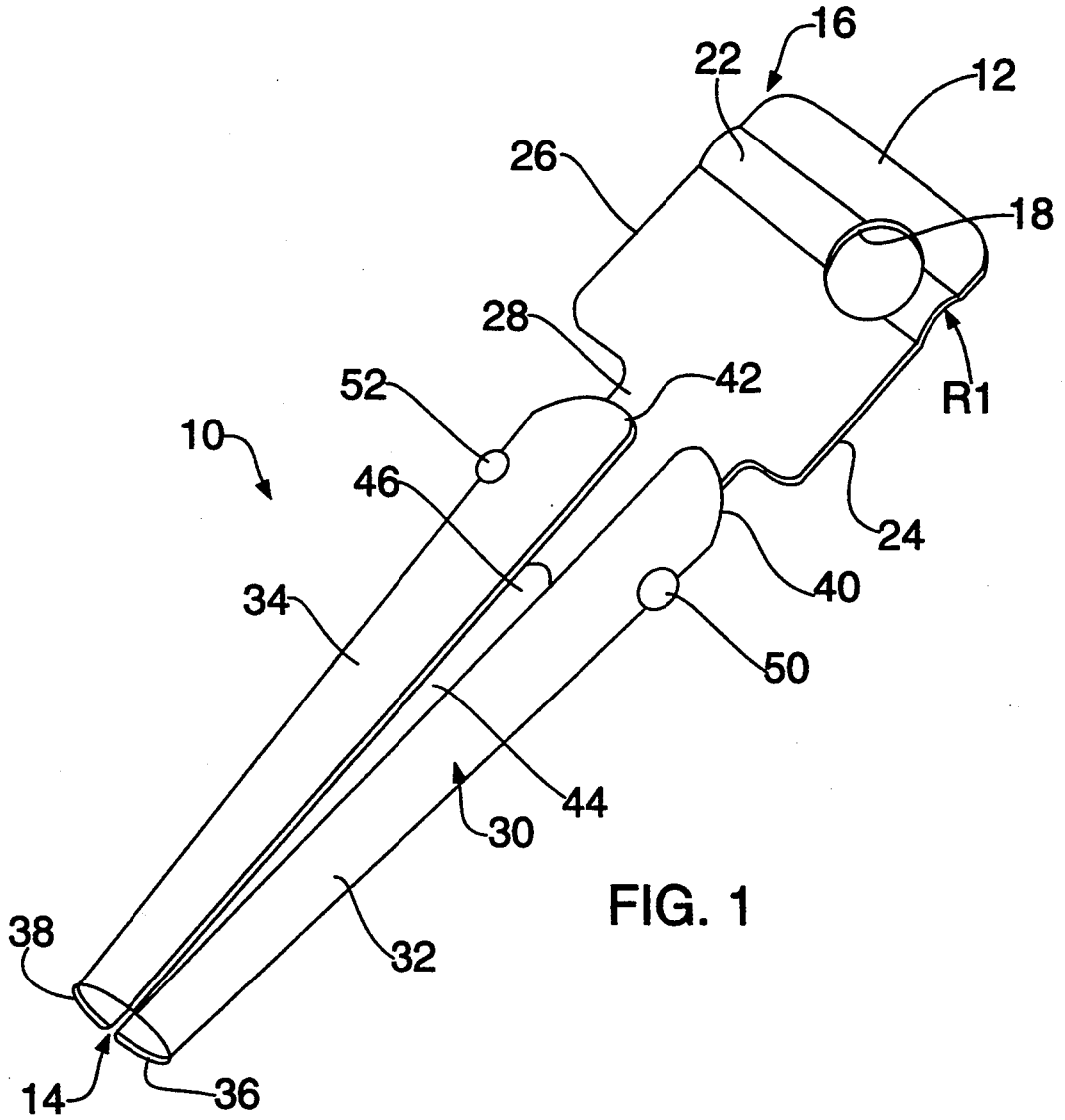
FIG. 1 is an upper right perspective view of the one-piece ground contact according to the present invention.

Referring now in more detail to the drawings, in FIG. 1 in a perspective view, a ground contact 10 according to the present invention is shown as a unitary one-piece element which extends from a mounting end 12 to an opposite receiving end 14. By using the terms "mounting" and "receiving", I am only attempting to distinguish the ends and provide a frame of reference for the reader. The mounting end forms part of a mounting tab 16 formed with a hole 18 therethrough which is capable of accepting the smaller diameter threaded shank of a clamp screw 20 (see FIGS. 9 and 10) therethrough.

Tab 16 is further formed with a linearly extending ridge or mound 22 which extends from tab side 24 to tab side 26. Tab 16 is integral with what I will herein refer to as a spring grip tube 30 which, in turn, extends between receiving end 14 and a contact neck portion 28 disposed between the tab 16 and the grip tube 30. Grip tube 30 is formed with a pair of curved spring members 32 and 34 which are spaced from one another in a manner whereby their ends 36 and 38 either are in contact with one another or are relatively closely spaced from one another, while ends 40 and 42 of the spring members 32 and 34 are more significantly separated from one another such that a pair of diametrically opposed gaps 44 and 46 exist between them.

Figure 5:
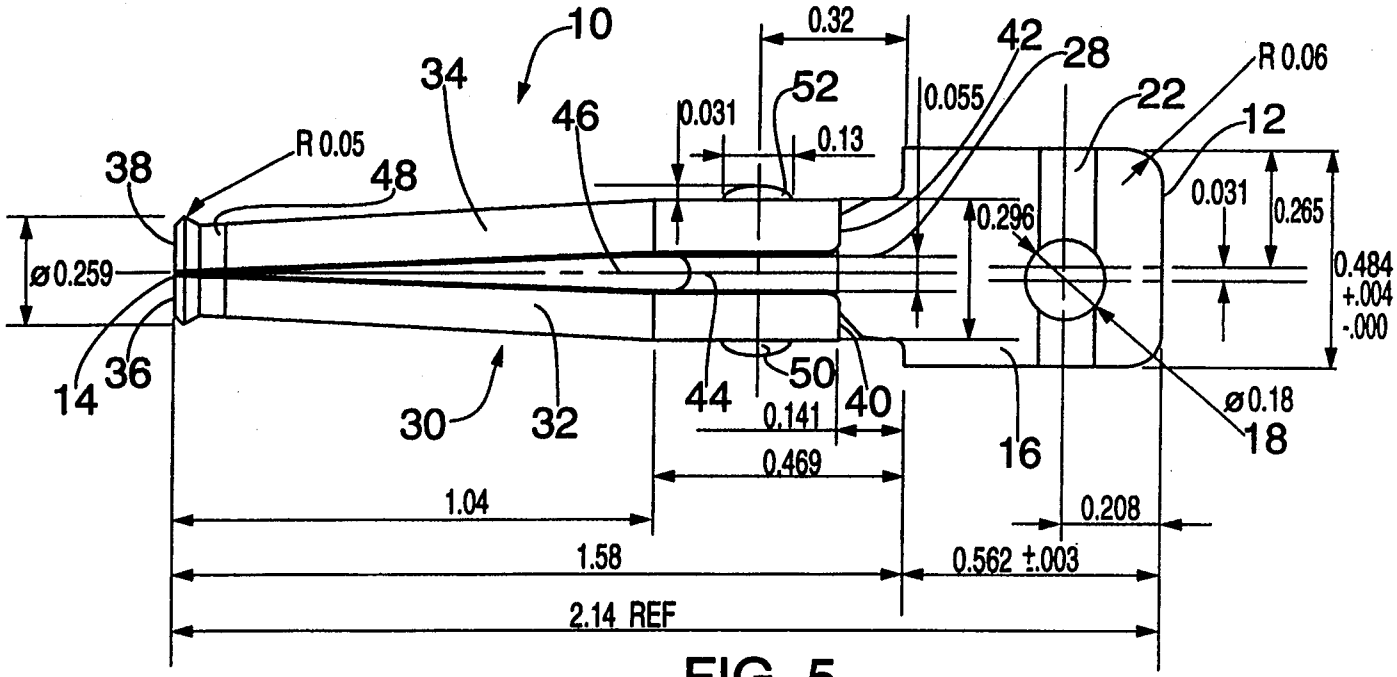
FIG. 5 is is a top plan view of the ground contact according to the present invention.
Figure 6:
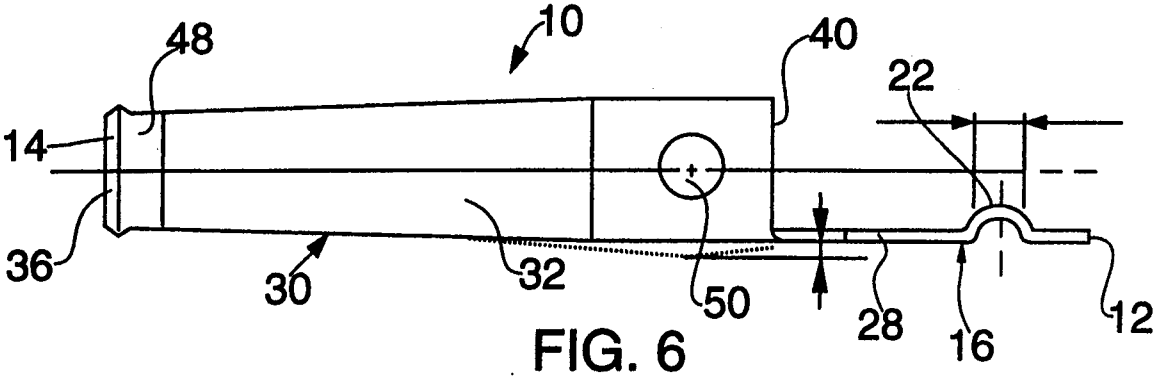
FIG. 6 is a side elevational view of the ground contact according to the present invention.
Figure 7:
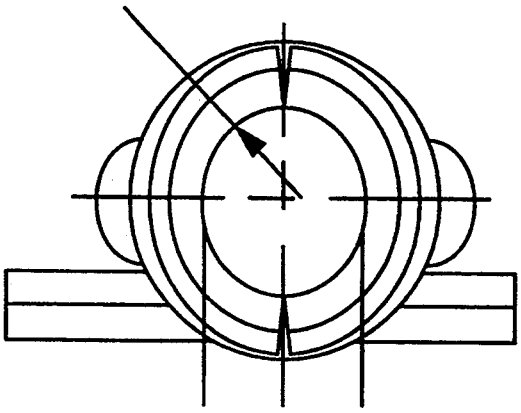
FIG. 7 is a receiving end view of the ground contact according to the present invention.
Figure 8:
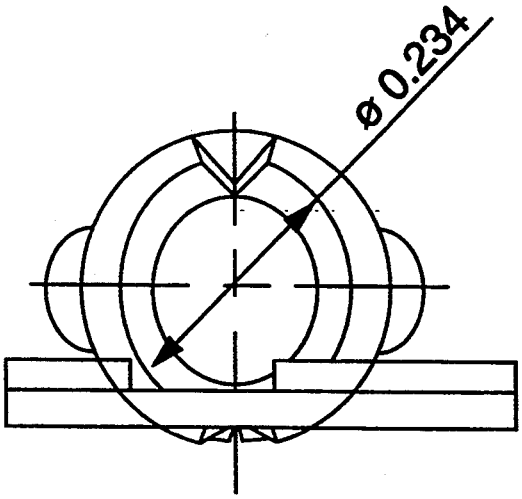
FIG. 8 is a mounting end view of the ground contact of the present invention.

Consistent with providing the reader of this specification with the best mode for carrying out the present invention, FIG. 5 has been provided with dimensions which, while preferred, are not intended to limit the invention. By way of example in this regard, while a pair of spring members 32 and 34 are illustrated, it is within the scope of the present invention to provide a plurality of such spring members which are not limited to two.

Similarly, while receiving end 14 includes a flared opening designed to matingly receive the ground pin of a mating plug assembly, the specific flare shown in the accompanying drawings need not be exactly followed to fall within the spirit of the present invention. The same is true with respect to the 0.055 inch wide gaps 44 and 46 at their greatest points. It is contemplated by this invention that the gap widen to its widest point from the receiving end where it is at its minimum.

The curvature of spring members 32 and 34 are preferably radial to provide a line of electrical contact between the inner surfaces at or near the receiving end and the ground pin received thereby. A relatively constant diameter portion 48 (FIG. 5) nearer the receiving end 14 extends from the radial outside flare to the relatively mid-portion of spring members 32 and 34 which progressively increase in diameter as they approach a point or line short of the contact neck portion 28.

Ground contact 10 is formed with a pair of protuberances 50 and 52 which extend radially outward from spring members 32 and 34, respectively (see FIGS. 1 and 5) and may have a hemispherical or other smooth shape. These protuberance comprise part of the wall of the spring members 32 and 34 and serve a unique and interesting function when ground contact 10 is inserted into the body of the connector within which it functions. FIG. 10 in a schematic-type sectional elevational view shows the location of one of the protuberances (protuberance 50) within elongated body bore 54 of connector body 56 of connector portion 80. Protuberances 50 and 52 make ground contact 10 self-centering within bore 54, such that the centerline of the ground contact grip tube 30 is coaxial with the centerline of the bore 54. This enables trouble-free mating engagement between the ground pin (not shown) and ground contact 10, and further facilitates the greatest range of resilient expansion of spring members 32 and 34 as the ground pin enters end 14.

The radius R1 of ridge or mound 22 is such that the convex surfaces of the ridge provide a bearing surface against which the bared ends of a conductor are brought into contact by means of a curved clamp member 98 (FIGS. 9 and 10) when wiring up the ground contact 10.

Figure 2:
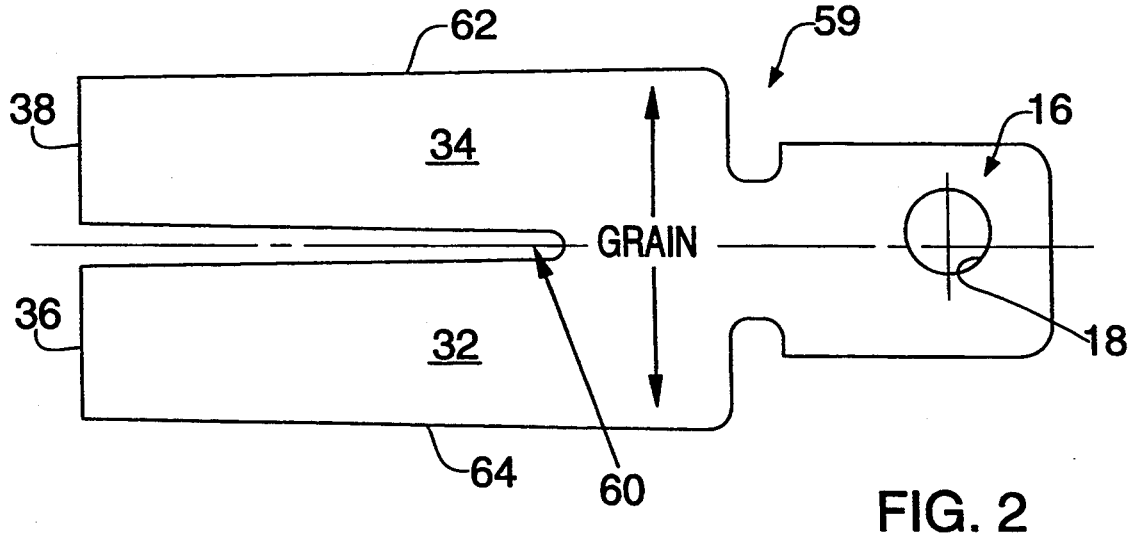
FIG. 2 is a top plan view of the flat metal stock blank from which the ground contact according to the present invention is fabricated.

Ground contact 10 is preferably formed from a blank piece of metal stock 59 illustrated in undeveloped form in plan view in FIG. 2. This single blank 59 is all that is required in the way of material to completely form the unitary one-piece ground contact 10. While the direction of the metal grain is shown in FIG. 2 to be transverse with respect to the longitudinal axis of the blank, the grain may run in other directions and still come within the contemplated scope of the present invention. The slot 60 comprises one of the gaps 44 and 46, while the other gap is created by tooled deformation of winged ends 62 and 64 of the blank. In FIG. 2 reference characters have been added which correspond to those of the fully formed ground contact, to illustrate where the formed configurations are derived from the blank, even though technically speaking the unformed portions bearing these reference characters do not perform the fully formed functions of those of the ground contact.

An advantage of the present invention over the prior art wherein machined two-piece contacts are assembled together resides in the ability of contact 10 to far better withstand relatively rough manipulation of the plug assembly 66 and connector assembly 68 containing contact 10 when they are joined by the user or installer. Ground contact 10, by its being formed from flat stock, is far more "foregiving" and is more resilient when compared to machined components, which provide poorer electrical contact pressures and are not as flexible as the contact of the present invention.

Figure 4:
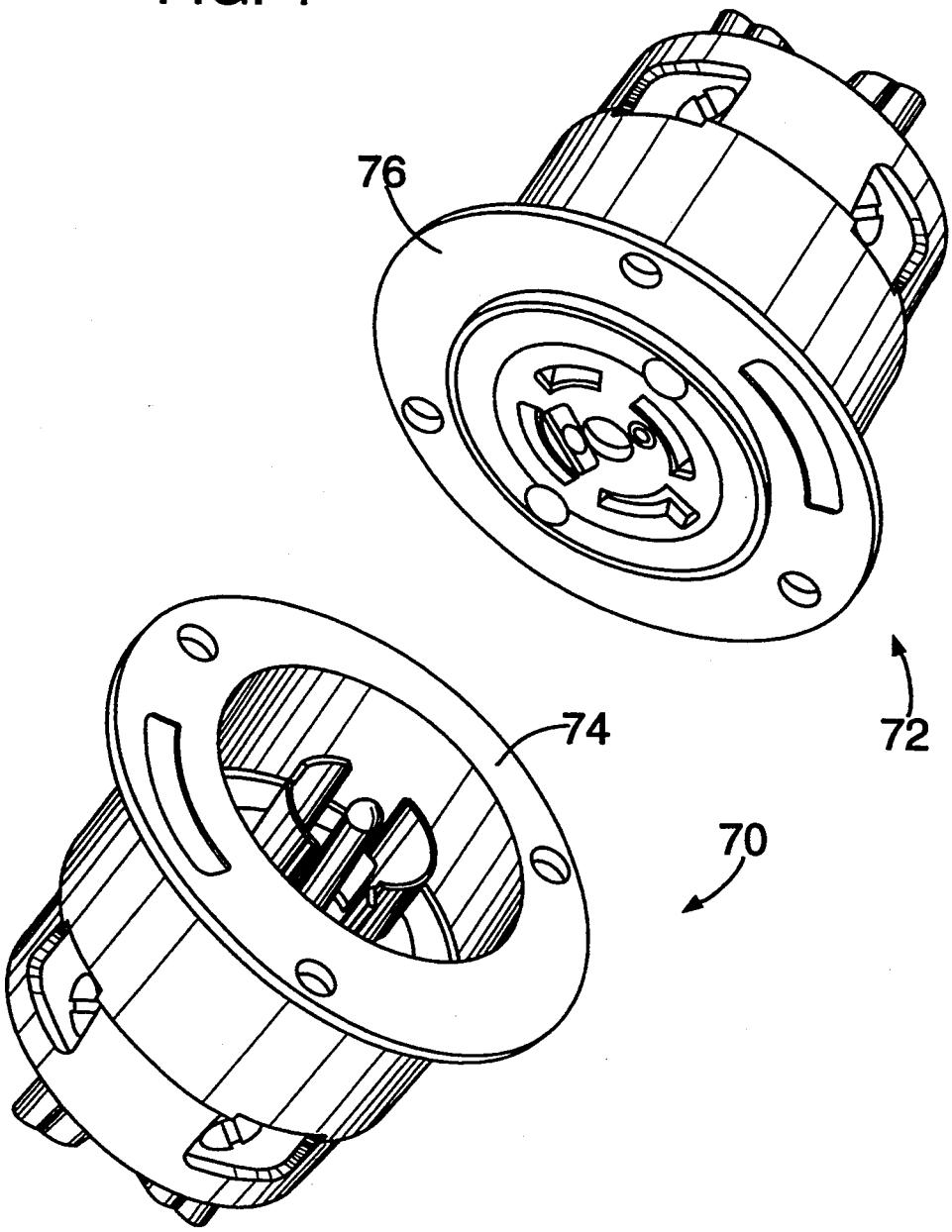
FIG. 4 is an upper right perspective view of another type of electrical connector equipped with the one-piece ground contact according to the present invention, illustrated adjacent its mating plug assembly.

FIGS. 3 and 4 do not have reference characters added for the various portions and components illustrated therein only because the configurations of the plugs and connectors illustrated therein do not go the heart of the present invention. However, the plug assemblies 66 and 70 and connector assemblies 68 and 72 shown in these views are presented to give the reader an appreciation of the type of environments the ground contact 10 according to the present invention operates. Plug and connector assemblies 70 and 72 are of a type which include mounting flanges 74 and 76, which enable these assemblies to be mounted to the surface of a panel with their respective bodies either recessed or not openly handled as in the case of plugs and connectors 66 and 68.

FIG. 9 illustrates a connector or receptacle assembly 68 which has had its component parts assembled. Its body components 80 and 82 are shown in cross section so that ground contact 10 is visible in a position ready to accepts its ground pin inserted through opening 84. A heavy duty cable 86 comprising an outer insulation includes three conductors which themselves are insulated, these insulations having been assigned reference characters 88, 90 and 92. Insulation 88 protects stranded conductor 94, illustrated in FIG. 9 connected by a clamp 98 and clamp screw 1 00 to line contact 102.

While the present invention has been described with respect to a preferred embodiment and other embodiments, it is intended that the scope of the present invention not be improperly limited and should be governed by the scope of the claims appended hereto.

What is claimed is:

1. A unitary one-piece ground contact for use as a component within an electrical connector, comprising, in combination:

a body formed from a single blank, said body having a first end and a second end, said body including a mounting tab portion at said body first end formed with an opening therethrough, a neck portion integral with said mounting tab portion, a generally cylindrical tube grip portion at said body second end, said tube grip portion integral with said mounting tab portion via said neck portion;

said tube grip portion comprising:

at least two spring members each formed with an arcuate configuration about a central longitudinal axis extending along said body from said first end to said second end, said spring members together generally describing a circular configuration with their respective concave inner surfaces facing one another, said spring members being disposed so as to define at least a pair of gaps therebetween, and said second end inwardly flared to receive a ground pin of an electrical plug, and self-centering means for aligning said contact within a bore in which said contact is disposed when in a functioning mode, said self-centering means including at least two protrusions, one for each of said at least two spring members formed as an integral part of its associated spring member for contacting the inner surfaces defining said bore.

2. A ground contact as defined in claim 1, wherein there are two spring members and two gaps.

3. A ground contact as defined in claim 1, where there are three spring members and three gaps.

4. A ground contact as defined in claim 1, wherein said at least two spring members at said body second end are more closely positioned with respect to one another than said at least two spring members adjacent said neck portion whereby said tube grip portion has a smaller diameter entry at said body second end than at its entry adjacent said neck portion.

5. A ground contact as defined in claim 1, wherein said tube grip portion has a constant diameter portion adjacent said flared second end to provide a line of electrical contact between said inner surfaces of said at least two spring members and the surface of a ground pin inserted into said tube grip portion.

6. A ground contact as defined in claim 1, wherein said mounting tab portion has a raised rib extending across its width perpendicular to said longitudinal axis adjacent its free end remote from said neck portion.

7. A ground contact as defined in claim 6, wherein said opening in said mounting tab portion extends through said raised rib.

8. A ground contact as defined in claim 7, further comprising a clamping screw passing through said opening in said mounting tab portion and a bared end of an insulated conductor clamped between said clamping screw and said raised rib.

9. A ground contact as defined in claim 8, wherein said clamping screw has a shank having a first end at which is located an enlarged head and a second end, said shank being externally threaded from said second end towards said first end; and a clamping member threadably coupled to said threaded portion of said shank whereby the bared end of the insulated conductor is clamped between said raised rib on said mounting tab portion and said clamping member.

10. A ground contact as defined in claim 9, wherein said clamping member is curved.

11. A ground contact as defined in claim 6, further comprising a clamping screw passing through said opening in said mounting tab portion and a bared end of an insulated conductor clamped between said clamping screw and said raised rib.

12. A ground contact as defined in claim 11, wherein said clamping screw has a shank having a first end at which is located an enlarged head and a second end, said shank being externally threaded from said second end towards said first end; and a clamping member threadably coupled to said threaded portion of said shank whereby the bared end of the insulated conductor is clamped between said raised rib on said mounting tab portion and said clamping member.

13. A ground contact as defined in claim 12, wherein said clamping member is curved.

* * * * *